US010145266B2

(12) United States Patent
Merry et al.

(10) Patent No.: US 10,145,266 B2
(45) Date of Patent: Dec. 4, 2018

(54) GAS TURBINE ENGINE SHAFT BEARING ARRANGEMENT

(75) Inventors: Brian D. Merry, Andover, CT (US); Gabriel L. Suciu, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 1699 days.

(21) Appl. No.: 13/362,237

(22) Filed: Jan. 31, 2012

(65) Prior Publication Data

US 2013/0195646 A1 Aug. 1, 2013

(51) Int. Cl.
*F01D 25/16* (2006.01)

(52) U.S. Cl.
CPC ..... *F01D 25/162* (2013.01); *F05D 2260/53* (2013.01)

(58) Field of Classification Search
CPC ..... F01D 25/16; F01D 25/162; F01D 25/164
USPC ..... 415/110, 111, 132, 142, 170.1, 229; 416/174
See application file for complete search history.

(56) References Cited

U.S. PATENT DOCUMENTS 3,287,906 A 11/1966 McCormick
3,727,998 A * 4/1973 Haworth et al. ..... 384/99
3,792,586 A * 2/1974 Kasmarik et al. ..... 60/226.1
3,925,979 A * 12/1975 Ziegler ..... 60/785
4,251,987 A * 2/1981 Adamson ..... 60/805
4,751,816 A * 6/1988 Perry ..... F02K 3/072 416/129
4,827,712 A * 5/1989 Coplin ..... 60/226.1
4,916,894 A * 4/1990 Adamson et al. ..... 60/226.1
5,433,674 A * 7/1995 Sheridan et al. ..... 475/346
5,915,917 A 6/1999 Eveker et al.
6,491,497 B1 12/2002 Allmon et al.
6,846,158 B2 * 1/2005 Hull ..... 416/1
7,021,042 B2 * 4/2006 Law ..... C23C 14/0623 384/913
7,097,413 B2 * 8/2006 VanDuyn ..... 415/9
7,309,210 B2 * 12/2007 Suciu ..... F01D 5/066 415/174.2
7,412,819 B2 * 8/2008 Bart et al. ..... 60/226.1
7,448,808 B2 11/2008 Bouchy et al.
7,490,460 B2 * 2/2009 Moniz et al. ..... 60/268
7,694,505 B2 4/2010 Schilling
7,704,178 B2 * 4/2010 Sheridan et al. ..... 475/159
(Continued)

FOREIGN PATENT DOCUMENTS

GB 1516041 6/1978
GB 2041090 9/1980
(Continued)

OTHER PUBLICATIONS

International Search Report and Written Opinion for International Application No. PCT/US2013/023556 completed on Sep. 17, 2013.
(Continued)

*Primary Examiner* — Richard Edgar
(74) *Attorney, Agent, or Firm* — Carlson, Gaskey & Olds, P.C.

(57) ABSTRACT

A gas turbine engine includes a shaft supported by first and second bearings for rotation relative to an inlet case. The first and second bearings are positioned within a common bearing compartment.

34 Claims, 2 Drawing Sheets

(56) References Cited

U.S. PATENT DOCUMENTS

| | | | | |
|---|---|---|---|---|
| 7,716,914 | B2 * | 5/2010 | Schilling | 60/268 |
| 7,832,193 | B2 * | 11/2010 | Orlando et al. | 60/268 |
| 7,882,693 | B2 | 2/2011 | Schilling | |
| 7,909,514 | B2 | 3/2011 | Plona | |
| 7,966,806 | B2 | 6/2011 | Henry et al. | |
| 2008/0148707 | A1 | 6/2008 | Schilling | |
| 2009/0081039 | A1 | 3/2009 | McCune et al. | |
| 2009/0148271 | A1 * | 6/2009 | Alvanos et al. | 415/142 |
| 2009/0293445 | A1 * | 12/2009 | Ress, Jr. | 60/39.15 |
| 2010/0148396 | A1 | 6/2010 | Xie et al. | |
| 2010/0154384 | A1 | 6/2010 | Schilling | |
| 2010/0331139 | A1 | 12/2010 | McCune | |
| 2011/0130246 | A1 | 6/2011 | McCune et al. | |

FOREIGN PATENT DOCUMENTS

| | | |
|---|---|---|
| WO | 2007038674 | 4/2007 |
| WO | 2010119115 A1 | 10/2010 |

OTHER PUBLICATIONS

Jane's Aero-Engines, Issue Seven, Copyright 2000, pp. 510-512.
European Search Report for European Patent Application No. 13805198.2 dated Oct. 12, 2015.
McMillian, A. (2008) Material development for fan blade containment casing. Abstract. p. 1. Conference on Engineering and Physics: Synergy for Success 2006. Journal of Physics: Conference Series vol. 105. London, UK. Oct. 5, 2006.
Kurzke, J. (2009). Fundamental differences between conventional and geared turbofans. Proceedings of ASME Turbo Expo: Power for Land, Sea, and Air. 2009, Orlando, Florida. pp. 145-153.
Agarwal, B.D and Broutman, L.J. (1990). Analysis and performance of fiber composites, 2nd Edition. John Wiley & Sons, Inc. New York: New York. pp. 1-30, 50-1, 56-8, 60-1, 64-71, 87-9, 324-9, 436-7.
Carney, K., Pereira, M. Revilock, and Matheny, P. (2003). Jet engine fan blade containment using two alternate geometries. 4th European LS-DYNA Users Conference. pp. 1-10.
Brines, G.L. (1990). The turbofan of tomorrow. Mechanical Engineering: The Journal of the American Society of Mechanical Engineers,108(8), 65-67.
Faghri, A. (1995). Heat pipe and science technology. Washington, D.C.: Taylor & Francis. pp. 1-60.
Hess, C. (1998). Pratt & Whitney develops geared turbofan. Flug Revue 43(7). Oct. 1998.
Grady, J.E., Weir, D.S., Lamoureux, M.C., and Martinez, M.M. (2007). Engine noise research in NASA's quiet aircraft technology project. Papers from the International Symposium on Air Breathing Engines (ISABE). 2007.
Griffiths, B. (2005). Composite fan blade containment case. Modern Machine Shop. Retrieved from: http://www.mmsonline.com/articles/composite-fan-blade-containment-case pp. 1-4.
Hall, C.A. and Crichton, D. (2007). Engine design studies for a silent aircraft. Journal of Turbomachinery, 129, 479-487.
Haque, A. and Shamsuzzoha, M., Hussain, F., and Dean, D. (2003). S20-glass/epoxy polymer nanocomposites: Manufacturing, structures, thermal and mechanical properties. Journal of Composite Materials, 37(20), 1821-1837.
Brennan, P.J. and Kroliczek, E.J. (1979). Heat pipe design handbook. Prepared for National Aeronautics and Space Administration by B & K Engineering, Inc. Jun. 1979. pp. 1-348.
Horikoshi, S. and Serpone, N. (2013). Introduction to nanoparticles. Microwaves in nanoparticle synthesis. Wiley-VCH Verlag GmbH & Co. KGaA. pp. 1-24.
Kerrebrock, J.L. (1977). Aircraft engines and gas turbines. Cambridge, MA: The MIT Press. p. 11.
Xie, M. (2008). Intelligent engine systems: Smart case system. NASA/CR-2008-215233. pp. 1-31.
Knip, Jr., G. (1987). Analysis of an advanced technology subsonic turbofan incorporating revolutionary materials. NASA Technical Memorandum. May 1987. pp. 1-23.
Willis, W.S. (1979). Quiet clean short-haul experimental engine (QCSEE) final report. NASA/CR-159473 pp. 1-289.
Kojima, Y., Usuki, A. Kawasumi, M., Okada, A., Fukushim, Y., Kurauchi, T., and Kamigaito, O. (1992). Mechanical properties of nylon 6-clay hybrid. Journal of Materials Research, 8(5), 1185-1189.
Kollar, L.P. and Springer, G.S. (2003). Mechanics of composite structures. Cambridge, UK: Cambridge University Press. p. 465.
Ramsden, J.M. (Ed). (1978). The new European airliner. Flight International, 113(3590). Jan. 7, 1978. pp. 39-43.
Langston, L. and Faghri, A. Heat pipe turbine vane cooling. Prepared for Advanced Turbine Systems Annual Program Review. Morgantown, West Virginia. Oct. 17-19, 1995. pp. 3-9.
Oates, G.C. (Ed). (1989). Aircraft propulsion systems and technology and design. Washington, D.C.: American Institute of Aeronautics, Inc. pp. 341-344.
Lau, K., Gu, C., and Hui, D. (2005). A critical review on nanotube and nanotube/nanoclay related polymer composite materials. Composites: Part B 37(2006) 425-436.
Shorter Oxford English dictionary, 6th Edition. (2007). vol. 2, N-Z. p. 1888.
Lynwander, P. (1983). Gear drive systems: Design and application. New York, New York: Marcel Dekker, Inc. pp. 145, 355-358.
Sweetman, B. and Sutton, O. (1998). Pratt & Whitney's surprise leap. Interavia Business & Technology, 53.621, p. 25.
Mattingly, J.D. (1996). Elements of gas turbine propulsion. New York, New York: McGraw-Hill, Inc. pp. 8-15.
Pyrograf-III Carbon Nanofiber. Product guide. Retrieved Dec. 1, 2015 from: http://pyrografproducts.com/Merchant5/merchant.mvc?Screen=cp_nanofiber.
Nanocor Technical Data for Epoxy Nanocomposites using Nanomer 1.30E Nanoclay. Nnacor, Inc. Oct. 2004.
Ratna, D. (2009). Handbook of thermoset resins. Shawbury, UK: iSmithers. pp. 187-216.
Wendus, B.E., Stark, D.F., Holler, R.P., and Funkhouser, M.E. (2003). Follow-on technology requirement study for advanced subsonic transport. NASA/CR-2003-212467. pp. 1-37.
Silverstein, C.C., Gottschlich, J.M., and Meininger, M. The feasibility of heat pipe turbine vane cooling. Presented at the International Gas Turbine and Aeroengine Congress and Exposition, The Hague, Netherlands. Jun. 13-16, 1994.pp. 1-7.
Merriam-Webster's collegiate dictionary, 11th Ed. (2009). p. 824.
Merriam-Webster's collegiate dictionary, 10th Ed. (2001). p. 1125-1126.
Whitaker, R. (1982). ALF 502: plugging the turbofan gap. Flight International, p. 237-241, Jan. 30, 1982.
Hughes, C. (2010). Geared turbofan technology. NASA Environmentally Responsible Aviation Project. Green Aviation Summit. NASA Ames Research Center. Sep. 8-9, 2010. pp. 1-8.
Gliebe, P.R. and Janardan, B.A. (2003). Ultra-high bypass engine aeroacoustic study. NASA/CR-2003-21252. GE Aircraft Engines, Cincinnati, Ohio. Oct. 2003. pp. 1-103.
Moxon, J. How to save fuel in tomorrow's engines. Flight International. Jul. 30, 1983. 3873(124). pp. 272-273.

* cited by examiner

GAS TURBINE ENGINE SHAFT BEARING ARRANGEMENT

BACKGROUND

This disclosure relates to a gas turbine engine bearing arrangement for a shaft. In one example, the bearing arrangement relates to a low shaft.

A typical jet engine has multiple shafts or spools that transmit torque between turbine and compressor sections of the engine. Each shaft is typically supported by a first bearing at a forward end of the shaft and a second bearing at an aft end of the shaft. The first bearing, for example, is a ball bearing that reacts to both axial and radial loads. The second bearing, for example, is a roller bearing or journal bearing that reacts only to radial loads. This bearing arrangement fully constrains the shaft except for rotation, and axial movement of one free end is permitted to accommodate engine axial growth.

SUMMARY

In one exemplary embodiment, a gas turbine engine includes a shaft defining an axis of rotation and first and second bearings supporting the shaft for rotation relative to an inlet case. The first and second bearings are positioned within a bearing compartment formed between the shaft and the inlet case.

In a further embodiment of the above, the inlet case portion comprises a first inlet case portion defining an inlet case flow path and a second inlet case portion removably secured to the first inlet case portion. The first and second bearings are mounted to the second inlet case portion.

In a further embodiment of any of the above, the gas turbine engine includes a compressor section with a compressor case having a first compressor case portion defining a compressor case flow path and a second compressor case portion removably secured to the first compressor case portion. A portion of the second inlet case portion is surrounded by the first compressor case portion.

In a further embodiment of any of the above, the shaft comprises a main shaft and a hub secured to the main shaft. The compressor section includes a rotor mounted to the hub, with the hub supporting the first and the second bearings.

In a further embodiment of any of the above, a geared architecture is coupled to the hub, and a fan is coupled to and rotationally driven by the geared architecture.

In a further embodiment of any of the above, the shaft includes a main shaft, a hub secured to the main shaft, and a flex shaft having at least one bellow. The flex shaft is secured to the hub at an aft end and is coupled to the geared architecture at a fore end.

In a further embodiment of any of the above, the geared architecture includes a sun gear supported on the fore end, a torque frame supporting multiple circumferentially arranged star gears intermeshing with the sun gear, and a ring gear meshing with the star gears.

In a further embodiment of any of the above, the aft end of the flex shaft is coupled to the hub at a connection interface, and the connection interface is positioned aft of the second bearing.

In a further embodiment of any of the above, the hub includes a first hub end and a second hub end, with the second bearing being directly supported by the first hub end and the first bearing being supported by the second hub end. The connection interface is positioned between the first and second hub ends.

In a further embodiment of any of the above, the first bearing is a ball bearing and the second bearing is a roller bearing.

In a further embodiment of any of the above, the ball bearing is located aft of the roller bearing, and the ball and roller bearings are generally aligned with each other in an axial direction defined by the shaft.

In a further embodiment of any of the above, including a compressor section with a plurality of vanes and a rotor supporting a plurality of blades interspersed with the plurality of vanes, and wherein the first and second bearings are positioned radially between the shaft and the blades.

In another exemplary embodiment, a gas turbine engine includes a core housing providing a core flow path and a shaft supporting a compressor section arranged within the core flow path. First and second bearings support the shaft for rotation relative to the core housing. The first and second bearings are positioned within a common bearing compartment positioned within the compressor section.

In a further embodiment of any of the above, an inlet case portion comprises a first inlet case portion defining an inlet case flow path and a second inlet case portion removably secured to the first inlet case portion. The first and second bearings are mounted to the second inlet case portion.

In a further embodiment of any of the above, the shaft includes a main shaft, a hub secured to the main shaft, and a flex shaft having at least one bellow. The flex shaft is secured to the hub at an aft end and is coupled to a geared architecture at a fore end. The first and second bearings are directly supported by the hub.

BRIEF DESCRIPTION OF THE DRAWINGS

The disclosure can be further understood by reference to the following detailed description when considered in connection with the accompanying drawings wherein.

DETAILED DESCRIPTION

Figure 1:
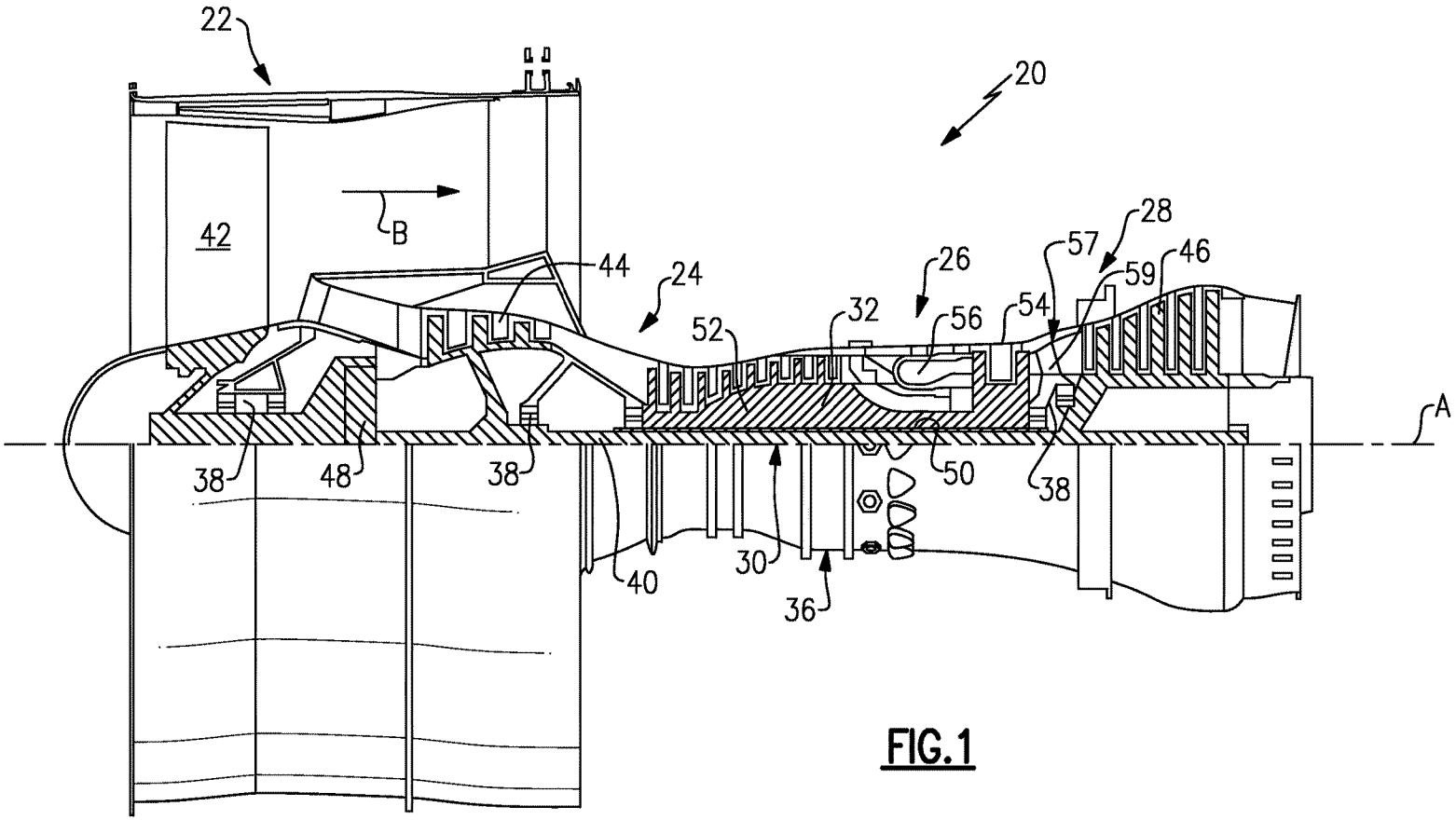
FIG. 1 schematically illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2:
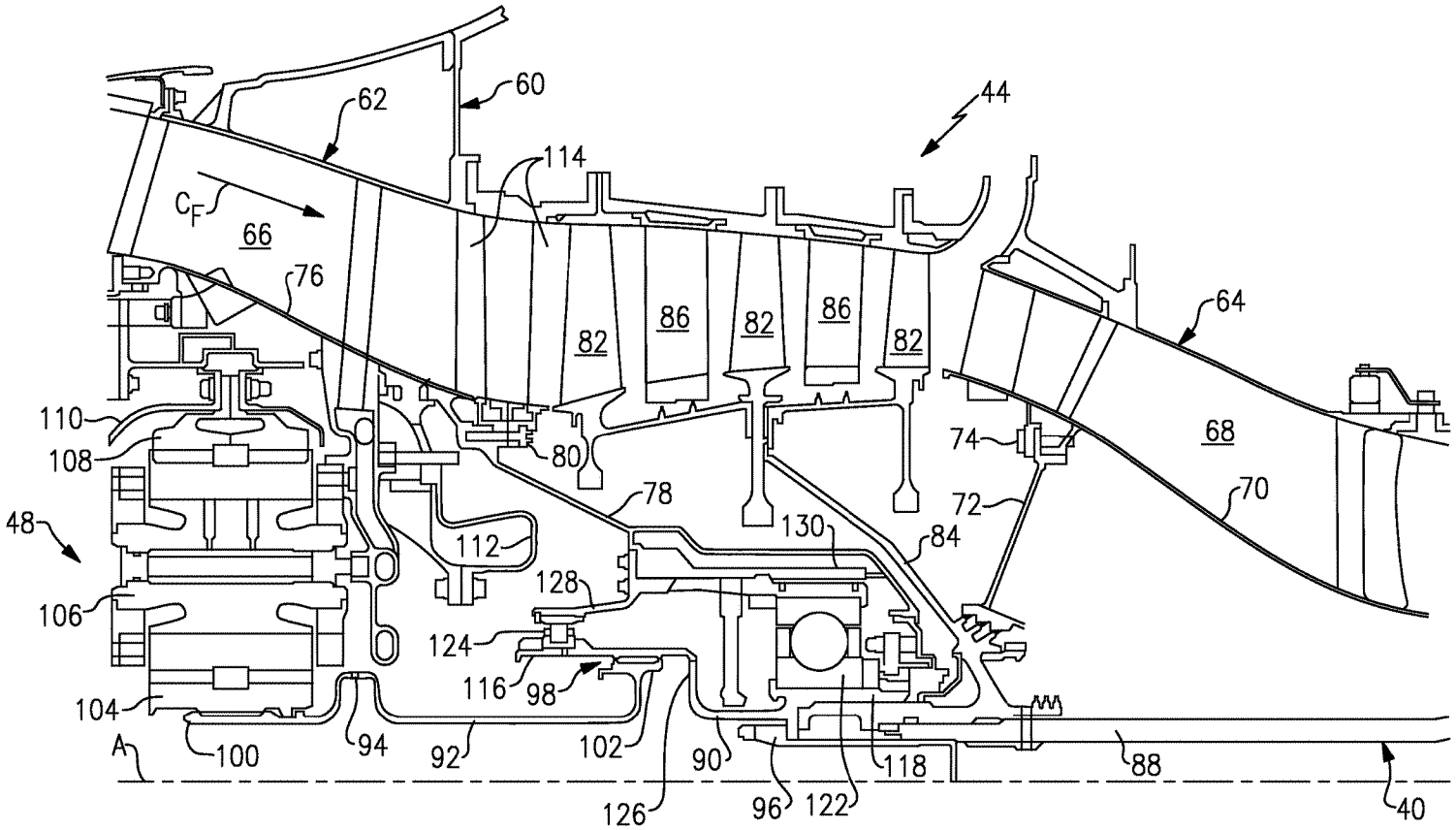
FIG. 2 is a cross-sectional view of an example of a front architecture of the gas turbine engine shown in FIG. 1.

Referring to FIG. 2, a core housing 60 includes an inlet case 62 and a compressor case 64 that respectively provide an inlet case flowpath 66 and a compressor case flowpath 68. Together, the inlet and compressor case flowpaths 66, 68, in part, define a core flowpath through the engine 20, which directs a core flow $C_F$.

The inlet case 62 and compressor case 64 are comprised of multiple components. For example, the compressor case 64 includes at least first 70 and second 72 compressor case portions, which are removably secured to one another at a connection interface 74. Also, for example, the inlet case 62 includes a first inlet case portion 76 and a second inlet case portion 78 that are removably secured to one another at a connection interface 80. The first inlet case portion 76 defines the inlet case flowpath 66 and the first compressor case portion 70 defines the compressor case flowpath 68.

The low pressure compressor 44 includes multiple compressor stages arranged between the inlet 66 and compressor 68 case flowpaths. Rotating blades 82 of the compressor stages are coupled to the inner shaft 40 by a rotor 84. Vanes 86 of the compressor stages are fixed to the compressor case 64 and are alternated with the blades 82.

In one example, the inner shaft 40 is constructed of multiple components that include, for example, a main shaft 88, a hub 90, and a flex shaft 92 with at least one bellow 94. The rotor 84 and hub 90 are clamped to the main shaft 88 with a nut 96. The flex shaft 92 is coupled to the hub 90 at a connection interface 98. The flex shaft 92 has a fore end 100 and an aft end 102. The aft end 102 is splined, for example, to the hub 90 at the connection interface 98. The fore end 100 is coupled to the geared architecture 48. The bellows 94 in the flex shaft 92 accommodates vibration in the geared architecture 48.

In one example, the fore end 100 of the flex shaft 92 is splined to and supports a sun gear 104 of the geared architecture 48. The geared architecture 48 also includes star gears 106 arranged circumferentially about and intermeshing with the sun gear 104. A ring gear 108 is arranged circumferentially about and intermeshes with the star gears 106. A fan structure 110 connects the ring gear 108 and the fan 42 (FIG. 1). A torque frame 112 supports the star gears 106 and grounds the star gears 106 to the housing 60. In operation, the inner shaft 40 rotationally drives the fan structure 110 with the rotating ring gear 108 through the grounded star gears 106.

The second inlet case portion 78 and torque frame 112 are secured to the first inlet case portion 76 at the connection interface 80. Struts 114 are arranged upstream of the vanes 86 to provide additional support at the connection interface 80. Although a particular configuration of low pressure compressor 44 is illustrated, it should be understood that other configurations may be used and still fall within the scope of this disclosure.

The hub 90 includes a fore hub end 116 and an aft hub end 118. The connection interface 98 to the flex shaft 92 is at a location that is between the fore 116 and aft 118 hub ends. The aft hub end 118 overlaps the rotor 84 such that at least a portion of the rotor 84 is located radially between the hub 90 and the main shaft 88.

The shaft 40 rotates about the engine central longitudinal axis A. A bearing compartment 120 is formed between the shaft 40 and the second inlet case portion 78. In the example shown, the bearing compartment 120 is formed between the hub 90 of the shaft 40 and the second inlet case portion 78. A first bearing 122 and a second bearing 124 support the shaft 40 for rotation relative to the inlet case 62. The first 122 and second 124 bearings are both positioned with the bearing compartment 120, i.e. the bearings are located within a common bearing compartment.

A portion of the second inlet case portion 78 extends into and is surrounded by the first compressor case portion 70. In one example, the first 122 and second 124 bearings include outer race portions that are mounted to the second inlet case portion 78. The blades 82 and vanes 86 of the low pressure compressor 44 are positioned radially outwardly relative to the first 122 and second 124 bearings.

As discussed above, the inner shaft 40 comprises the main shaft 88 and the hub 90 which is secured to the main shaft 88. The rotor 84 is mounted to the aft end 118 of the hub 90. The hub 90 directly supports the inner races of the first 122 and the second 124 bearings. The fore hub end 116 supports the second bearing 124 and the aft hub end 118 supports the first bearing 122. The aft end 102 of the flex shaft 92 is coupled to the hub 90 at the connection interface 98, which is positioned aft of the second bearing 124.

In one example, the first bearing 122 is a ball bearing and the second bearing 124 is a roller bearing. As such, in this example, the ball bearing is located aft of the roller bearing. The ball bearing constrains the inner shaft 40 against axial and radial movement at a forward portion of the inner shaft 40. The roller bearing reacts only to radial loads.

In one example, the first 122 and second 124 bearings are generally aligned with each other in an axial direction defined by the shaft 40. The fore hub end 116 is spaced further radially away from the axis A than the aft hub end 118. A transition portion 126 of the hub 90 connects the radially outer fore hub end 116 to the radially inner aft hub end 118. The second inlet case portion 78 includes a fore flange portion 128 that supports the second bearing 124 and an aft flange portion 130 that supports the first bearing 122. The fore flange portion 128 is radially closer to the axis A than the aft flange portion 130.

The inner shaft 40 of the geared fan engine can be subjected to very high rpm loads, which may cause rotor dynamic issues. These dynamic issues increase the longer and smaller in diameter the shaft becomes. Adding an additional bearing at a fore end of the shaft facilitates control of shaft dynamic modes and allows the use of longer and smaller diameter shafts. By adding another bearing in the existing bearing compartment extra carbon seals are not required. Further, minimal weight is added to the system due to the location of the additional bearing relative to the shaft.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

a shaft defining an axis of rotation;

an inlet case comprising a non-rotating core housing that defines a core flowpath through the gas turbine engine, and wherein the inlet case comprises a first inlet case portion defining an inlet case flow path and a second inlet case portion removably secured to the first inlet case portion;

a first bearing supporting the shaft for rotation relative to the inlet case, the first bearing being positioned within a bearing compartment formed between the shaft and the second inlet case portion;

a second bearing also supporting the shaft for relative rotation to the inlet case, the second bearing also being positioned within the bearing compartment, and wherein the first and second bearings are mounted to the second inlet case portion; and a compressor section with at least a low pressure compressor and a high pressure compressor, and which includes a plurality of vanes and a rotor supporting a plurality of blades interspersed with the plurality of vanes, and wherein the first and second bearings are positioned radially between the shaft and the blades, and wherein the second inlet case portion includes a fore end that is removably secured to the first inlet case portion at a first connection interface that is positioned forward of the rotor and the compressor section.

2. The gas turbine engine according to claim 1, wherein the compressor section includes a compressor case having a first compressor case portion defining a compressor case flow path and a second compressor case portion removably secured to the first compressor case portion at a second connection interface that is positioned aft of the first connection interface, and wherein the second inlet case portion extends aft of the first inlet case portion such that an aft end of the second inlet case portion is surrounded by the compressor section.

3. The gas turbine engine according to claim 2, wherein the shaft comprises a main shaft and a hub secured to the main shaft, and wherein the rotor is mounted to the hub, the hub supporting the first and the second bearings, and wherein the second inlet case portion extends forward of the rotor and the compressor section.

4. The gas turbine engine according to claim 3, including a geared architecture coupled to the hub, and a fan coupled to and rotationally driven by the geared architecture.

5. The gas turbine engine according to claim 2, wherein the low pressure compressor includes the rotor which is mounted for rotation with the shaft, and wherein the fore end of the second inlet case portion extends forward of the rotor.

6. The gas turbine engine according to claim 2, wherein the first and second bearings are positioned aft of the first connection interface and forward of the second connection interface.

7. The gas turbine engine according to claim 1, wherein the first bearing is a ball bearing and the second bearing is a roller bearing, and wherein the first and second bearings are positioned downstream of a geared architecture that couples the shaft to a fan.

8. The gas turbine engine according to claim 7, wherein the ball bearing is located aft of the roller bearing, and wherein the ball and roller bearings are generally concentric and axially spaced apart from each other.

9. The gas turbine engine according to claim 1, wherein the first and second bearings are positioned axially aft of the first connection interface.

10. The gas turbine engine according to claim 1, wherein the second inlet case portion includes a fore flange portion that directly supports the second bearing and an aft flange portion that directly supports the first bearing.

11. The gas turbine engine according to claim 10, wherein the fore flange portion is radially closer to the axis of rotation than the aft flange portion.

12. The gas turbine engine according to claim 11, including a hub having an aft hub end coupled to the shaft and fore hub end coupled to a flex shaft at a second connection interface, wherein the flex shaft drives a geared architecture, and wherein the fore hub end directly supports the second bearing and the aft hub end directly supports the first bearing, and wherein the second connection interface is positioned axially between the first and second bearings.

13. The gas turbine engine according to claim 12, wherein the fore hub end is spaced further radially away from the axis of rotation than the aft hub end, and wherein the first and second bearings are generally concentric and axially spaced apart from each other.

14. The gas turbine engine according to claim 1, including a geared architecture coupled to the shaft and a fan coupled to and rotationally driven by the geared architecture, and wherein the geared architecture includes an inner gear driven by the shaft, a plurality of outer gears meshing with the inner gear, and a ring gear in meshing engagement with the outer gears, the ring gear driving the fan.

15. The gas turbine engine according to claim 1, wherein the compressor section includes a compressor case that is attached to the inlet case, and including at least one strut positioned upstream of the compressor section and held fixed to the non-rotating core housing to support the inlet case.

16. The gas turbine engine according to claim 15, and wherein the first bearing comprises a fore bearing and the second bearing comprises an aft bearing that is spaced axially aft of the fore bearing, and wherein the fore bearing is in a radially overlapping relationship with the at least one strut.

17. A gas turbine engine comprising:

a shaft defining an axis of rotation, wherein the shaft comprises a main shaft and a hub secured to the main shaft;

a first bearing supporting the shaft for rotation relative to an inlet case, the first bearing being positioned within a bearing compartment formed between the shaft and the inlet case;

a second bearing also supporting the shaft for relative rotation to the inlet case, the second bearing also being positioned within the bearing compartment;

a compressor section with a compressor case having a first compressor case portion defining a compressor case flow path and a second compressor case portion removably secured to the first compressor case portion;

wherein the inlet case comprises a first inlet case portion defining an inlet case flow path and a second inlet case portion removably secured to the first inlet case portion, the first and second bearings being mounted to the second inlet case portion, and wherein a portion of the second inlet case portion is surrounded by a portion of the compressor section, and wherein the compressor section includes a rotor mounted to the hub, the hub supporting the first and the second bearings;

a geared architecture coupled to the hub, and a fan coupled to and rotationally driven by the geared architecture; and a flex shaft having at least one bellow, and wherein the flex shaft is secured to the hub at an aft end and is coupled to the geared architecture at a fore end, and wherein the aft end of the flex shaft is coupled to the hub at a connection interface, and wherein the connection interface is positioned aft of the second bearing.

18. The gas turbine engine according to claim 17, wherein the geared architecture includes a sun gear supported on the fore end of the flex shaft, a torque frame supporting multiple circumferentially arranged star gears intermeshing with the sun gear, and a ring gear meshing with the star gears.

19. The gas turbine engine according to claim 17, wherein the hub includes a fore hub end and an aft hub end, the second bearing being directly supported by the fore hub end and the first bearing being supported by the aft hub end with the connection interface being positioned between the fore and aft hub ends.

20. The gas turbine engine according claim 17, wherein the first bearing is a ball bearing and the second bearing is a roller bearing.

21. A gas turbine engine comprising:

a core housing providing a core flow path, the core housing comprising a non-rotating inlet case having at least a first inlet case portion defining an inlet case flow path and a second inlet case portion removably secured to the first inlet case portion;

a shaft supporting a compressor section arranged within the core flow path;

a geared architecture coupled to the shaft and a fan coupled to and rotationally driven by the geared architecture;

first and second bearings mounted to the second inlet case portion and supporting the shaft for rotation relative to the core housing, and wherein the first and second bearings are positioned within a common bearing compartment positioned within the compressor section; and a compressor section with at least a low pressure compressor and a high pressure compressor, and which includes a plurality of vanes and a rotor supporting a plurality of blades interspersed with the plurality of vanes, and wherein the first and second bearings are positioned radially between the shaft and the blades, and wherein the second inlet case portion includes an aft end that is surrounded by the compressor section and a fore end that extends forward of the rotor and the compressor section.

22. The gas turbine engine according to claim 21, wherein the shaft includes a main shaft, a hub secured to the main shaft, and a flex shaft having at least one bellow, and wherein the flex shaft is secured to the hub at an aft end and is coupled to the geared architecture at a fore end, and wherein the first and second bearings are directly supported by the hub.

23. The gas turbine engine according to claim 21, wherein the first bearing is a ball bearing and the second bearing is a roller bearing.

24. The gas turbine engine according to claim 23, wherein the ball bearing is located aft of the roller bearing.

25. The gas turbine engine according to claim 21, wherein the bearing compartment is formed between the shaft and the second inlet case portion, and wherein the first and second bearings are positioned axially aft of a first connection interface between the first and second inlet case portions.

26. The gas turbine engine according to claim 25, wherein the second inlet case portion includes a fore flange portion that directly supports the second bearing and an aft flange portion that directly supports the first bearing.

27. The gas turbine engine according to claim 26, including a hub having an aft hub end coupled to the shaft and fore hub end coupled to a flex shaft at a second connection interface, wherein the flex shaft drives a geared architecture, and wherein the fore hub end directly supports the second bearing and the aft hub end directly supports the first bearing, and wherein the second connection interface is positioned axially between the first and second bearings.

28. The gas turbine engine according to claim 27, wherein the fore flange portion is radially closer to the axis of rotation than the aft flange portion, and wherein the fore hub end is spaced further radially away from the axis of rotation than the aft hub end, and wherein the first and second bearings are generally concentric and axially spaced apart from each other.

29. The gas turbine engine according to claim 21, wherein the first and second bearings are positioned downstream of the geared architecture.

30. The gas turbine engine according to claim 21, wherein the first and second inlet case portions are connected to each other at a first connection interface, and including at least one strut positioned upstream of the compressor section and held fixed to the core housing to support the inlet case, and wherein the first connection interface is radially inward of the strut such that the first connection interface and strut overlap each other in a radial direction.

31. The gas turbine engine according to claim 30, and wherein the first bearing comprises a fore bearing and the second bearing comprises an aft bearing that is spaced axially aft of the fore bearing, and wherein the fore bearing is in a radially overlapping relationship with the at least one strut.

32. The gas turbine engine according to claim 21, wherein the first inlet case portion is removably secured to the second inlet case portion at a first connection interface, and wherein the compressor section has a compressor case having at least a first compressor case portion defining a compressor case flow path and a second compressor case portion removably secured to the first compressor case portion at a second connection interface that is positioned aft of the first connection interface, and wherein the second inlet case portion extends aft of the first inlet case portion such that the aft end of the second inlet case portion is surrounded by the compressor section.

33. The gas turbine engine according to claim 32, wherein the low pressure compressor includes the rotor which mounted for rotation with the shaft, and wherein the fore end of the second inlet case portion extends forward of the rotor.

34. The gas turbine engine according to claim 32, wherein the first and second bearings are positioned aft of the first connection interface and forward of the second connection interface.

* * * * *